United States Patent [19]

Arthurs

[11] Patent Number: 4,986,416

[45] Date of Patent: Jan. 22, 1991

[54] BAG BOTTLE CARRIER

[76] Inventor: Raymond C. Arthurs, 50 Trudelle St., Scarborough, Ontario, Canada, M1J 1Z3

[21] Appl. No.: 190,474

[22] Filed: May 5, 1988

[51] Int. Cl.[5] ..... B65D 75/00

[52] U.S. Cl. ..... 206/170; 206/175; 206/174; 206/427

[58] Field of Search ..... 206/158, 162, 170, 174, 206/175, 196, 197, 200, 201, 427, 434; 229/52 BC, 41 B; 383/38, 119

[56] References Cited

U.S. PATENT DOCUMENTS

| | | | |
|---|---|---|---|
| D. 192,756 | 9/1960 | Hodgman . | |
| 2,653,742 | 9/1953 | Currie | 206/196 |
| 2,665,049 | 1/1954 | George | 229/52 BC |
| 3,008,605 | 11/1961 | Vesak | 206/200 |
| 3,039,651 | 6/1962 | Lang | 206/174 |
| 3,045,863 | 7/1962 | De Chelbor . | |
| 3,298,563 | 1/1967 | Rabb . | |
| 3,309,970 | 3/1967 | Pierce | 229/41 B |
| 3,333,729 | 8/1967 | Rabb . | |
| 3,393,828 | 7/1968 | Atkinson | 206/200 |
| 3,404,805 | 10/1968 | Stockman et al. . | |
| 3,625,393 | 12/1971 | Mittel . | |

FOREIGN PATENT DOCUMENTS

| | | |
|---|---|---|
| 685566 | 4/1964 | Canada . |
| 757444 | 4/1967 | Canada . |
| 817237 | 9/1969 | Canada . |
| 45948 | 9/1979 | Canada . |

*Primary Examiner*—David T. Fidei

*Attorney, Agent, or Firm*—Brian W. Gray; J. D. Kendry

[57] ABSTRACT

A carrier for carrying a predetermined number, generally six, bottles. The carrier is made from two parts: a stiff plastic frame and a flexible plastic bag. The frame is made up of a rectangular collar, and a lattice which divides the frame into a network of two rows, each row having three compartments. The frame is also provided with a handle connected to the top of center lattice divider between the two rows. The bag is rectilinear, and the cross-section of its open end matches the collar of the frame. When assembled, the top, open end of the bag is glued or welded to the collar and hangs from the frame. The assembled unit thus provides a plastic carrier, with a handle into which can fit six bottles. The corners of the collar and lattice network of the frame can be hinged so that an empty carrier can be made compact by collapsing the carrier on itself. The plastic bag is made by cutting perpendicularly across the length of a tube of plastic film which has two equal tucks along its length and then heat sealing the piece along the new cut.

20 Claims, 3 Drawing Sheets

FIG. 2
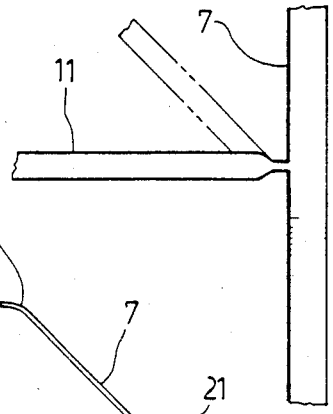
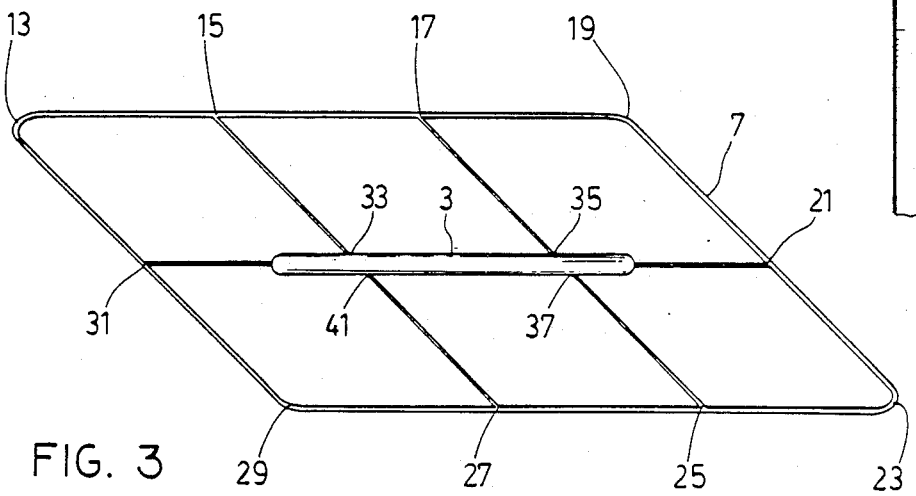
FIG. 3
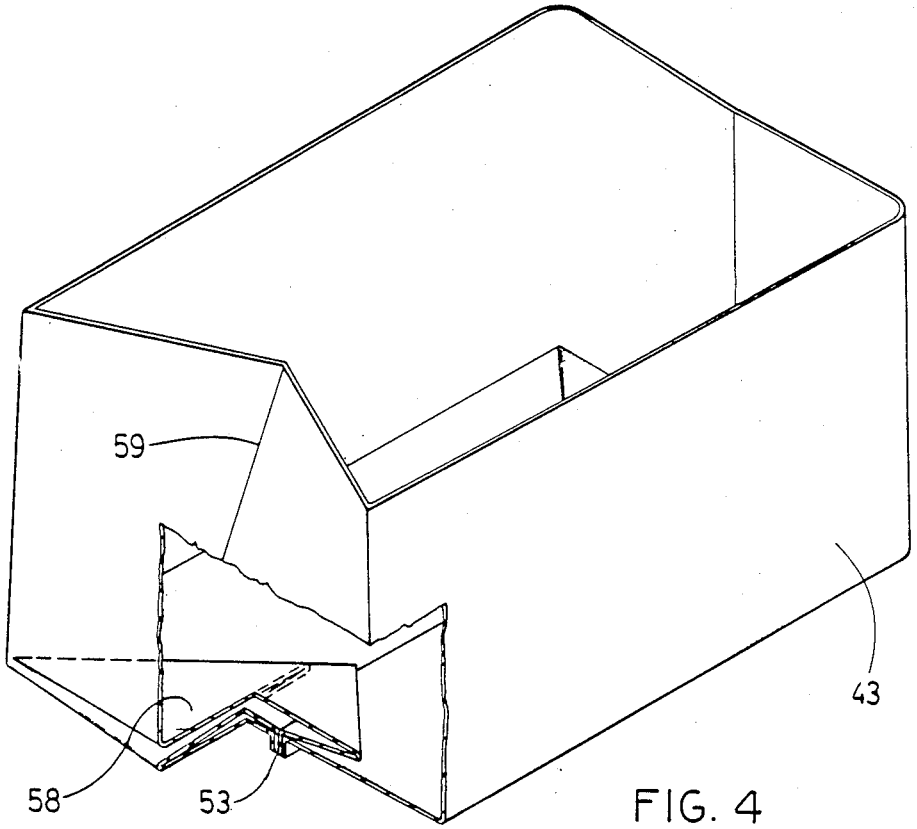
FIG. 4

BAG BOTTLE CARRIER

FIELD OF THE INVENTION

The present invention generally relates to a carrier for carrying a plurality of articles, such as bottles.

BACKGROUND OF THE INVENTION

Many articles, such as soft drinks, are packaged in bottles or other forms of containers and sold to the public in carriers accommodating the plurality of such containers. Accordingly, a wide variety of carriers have been developed for carrying a plurality of articles. Most such carriers are designed to be discarded after one use. However, for reuseable containers, such as returnable bottles, it is convenient to have a carrier which is also reuseable.

Particularly, with reuseable carriers and even with disposable carriers, there is frequently a storage and shipping problem in that bottlers must be shipped a supply a carriers. Shipment costs may be high, and bottlers must maintain an inventory of carriers for use, leading to storage costs.

In addition, the carrier must be relatively cheap and relatively durable. Preferably, it should collapse to allow for ease of shipment and storage. It must be designed so that containers, such as bottles, can be loaded onto the carrier by the use of mass production bottling equipment. In addition, it should be possible to wash the carrier after each use and finally, it would be preferable if material could be printed on the carrier for advertising purposes.

A number of reuseable carriers have been developed to satisfy these criteria. One such carrier commonly used and manufactured by Scepter Manufacturing Company comprises a stiff plastic box open at the top and divided into a series of container receiving compartments. A handle is connected to the open end of the box for carrying it. If the whole box is relatively rigid and forms a number of relatively rigid compartments, the box can be filled by the use of mass production machinery. The box can be imprinted after manufacture and is sufficiently durable to be re-used several times. However, as the carrier is made out of heavy plastic, it is not collapsible and is therefore very bulky and awkward to store when not in use and expensive to ship to a bottling plant. Further, such carriers are relatively expensive to manufacture because they must be manufactured in a central molding plant and require a considerable amount of plastic.

It would, therefore, be desirable to have a carrier which was collapsible, used a minimum amount of plastic and yet still provided for top end loading by a bottle loading machine and which was sufficiently durable to carry heavy loads generated by six or more relatively full soda pop bottles. In addition, it would be useful if the carrier was fully enclosed allowing for an outer surface to protect the bottle and an area to imprint trade marks or trade names.

A number of cardboard carriers are collapsible and are relatively cheap to manufacture. Some are hinged at the corners to allow to cardboard areas to collapse. The carrier is assembled and forms a permanent structure when one part of it, such as the bottom is glued.

Another type of cardboard carrier collapses sideways with one side folding in and the opposite side and bottom folding out to create a substantially flat carrier when not in use for shipping and storage. Cardboard, however, is not very sturdy for multiple uses. Also, bottling plants, by their nature are wet, and water weakens cardboard. In addition, such carriers are normally shipped and stored in plastic cases which need to be washed. This means that cardboard carriers must be removed before, and reinserted into the plastic cases after each washing.

The cheapest form of collapsible container is a plastic bag. However, such a container provides no protection between bottles inserted into it and in addition cannot be filled by mechanized bottling machinery. In addition, because the weight distribution in an ordinary plastic bag is uneven, such bags are subject to breakage from localized unevenly distributed stress.

Consequently, a need exists for an improved reuseable, collapsible, plastic carrier for carrying a plurality of articles which will be dependable, relatively inexpensive to manufacture and to use, will provide a surface for imprinting on the carrier, will be relatively easy to, store and which can be loaded by mechanized bottling equipment.

SUMMARY OF THE INVENTION

The present invention provides a collapsible carrier for carrying a number of articles, such as bottles, to satisfy some of the aforementioned needs. The carrier comprises a substantially stiff frame which allows for the mechanized loading of bottles or articles into the carrier. A cellular structure is provided within the frame to divide at least part of the interior of the frame into article receiving compartments. This will assist the mechanized loading of the carrier as well as dividing the bottles or other fragile articles from each other to avoid internal clanking of the articles with each other and internal shifting of the articles within the carrier.

The cellular structure is formed from intersecting walls extending within and connected to the frame and the intersections of the walls. A handle is also provided substantially along the centre line of the frame to provide ease of carrying the device. Finally, a plastic bag is folded to create a substantially rectangular bottom and is sized to fit over the outer dimensions of the frame and secured to the frame.

By the use of a collapsible bag, it is possible to collapse this container for storage while not in use. As well, by using a substantially stiff frame, it is possible to allow for mechanized loading and to use a bag made up of relatively thin plastic film material, thereby allowing the container to be collapsible and also avoiding the cost inherent in the quantity of plastic used in current carriers.

Accordingly, the present invention relates to an apparatus and method of making a carrier for carrying a plurality of articles comprising a substantially stiff frame having a cellular structure to divide the interior of the frame into article receiving compartments, a substantially rigid handle connected to the frame substantially along the centre line of the frame, said handle being substantially perpendicular to the plane formed by the frame.

Attached to the cellular frame is a bag closed at one end and open at the other having its open end sized to fit over the outer dimensions of the frame and secured thereto.

In some embodiments, the cellular structure is extended into the bag to form a series of dividers to further divide the interior of the bag into article receiving compartments.

In these embodiments, it is preferable, in another aspect of the invention, that the joints in the cellular structure and the frame be hinged or pivotally connected so that the frame may be substantially collapsed towards the plane of the rigid handle. The means of hinging the joints may include coining or thinning the material at the joints.

The carrier is normally substantially rectangular. Preferably, the bag may be made from seamless plastic tubing and may be heat sealed to the carrier frame which may also be made of plastic. Normally, the bag would not be designed to be removed from the frame. However, the seal between the frame and the bag may be designed such that under certain conditions the bag may be disengaged from the frame, but under normal operating conditions, it will be securely fastened to the frame.

The bag can be made of a material upon which printing can be provided or it may be transparent and printing may be provided on the inside which can be viewed from the outside. A handle may be provided which can move up and down along its own plane in relation to the substantially stiff frame. Finally, means for stiffening the closed end of the bag can be included to provide more structural support to the carrier device yet preserve its collapsible nature.

BRIEF DESCRIPTION OF THE DRAWINGS In drawings which illustrate embodiments of the invention, FIG. 1 is an exploded prospective view of a preferred embodiment of the invention.

FIG. 2 is a detail of a coined or thinned area in FIG. 1.

FIG. 3 is a top profile view of the preferred embodiment in a partially collapsed state.

FIG. 4 is a prospective, partially cut-away view of the bag in the preferred embodiment.

DETAILED DESCRIPTION OF THE PREFERRED EMBODIMENT

Figure 1:
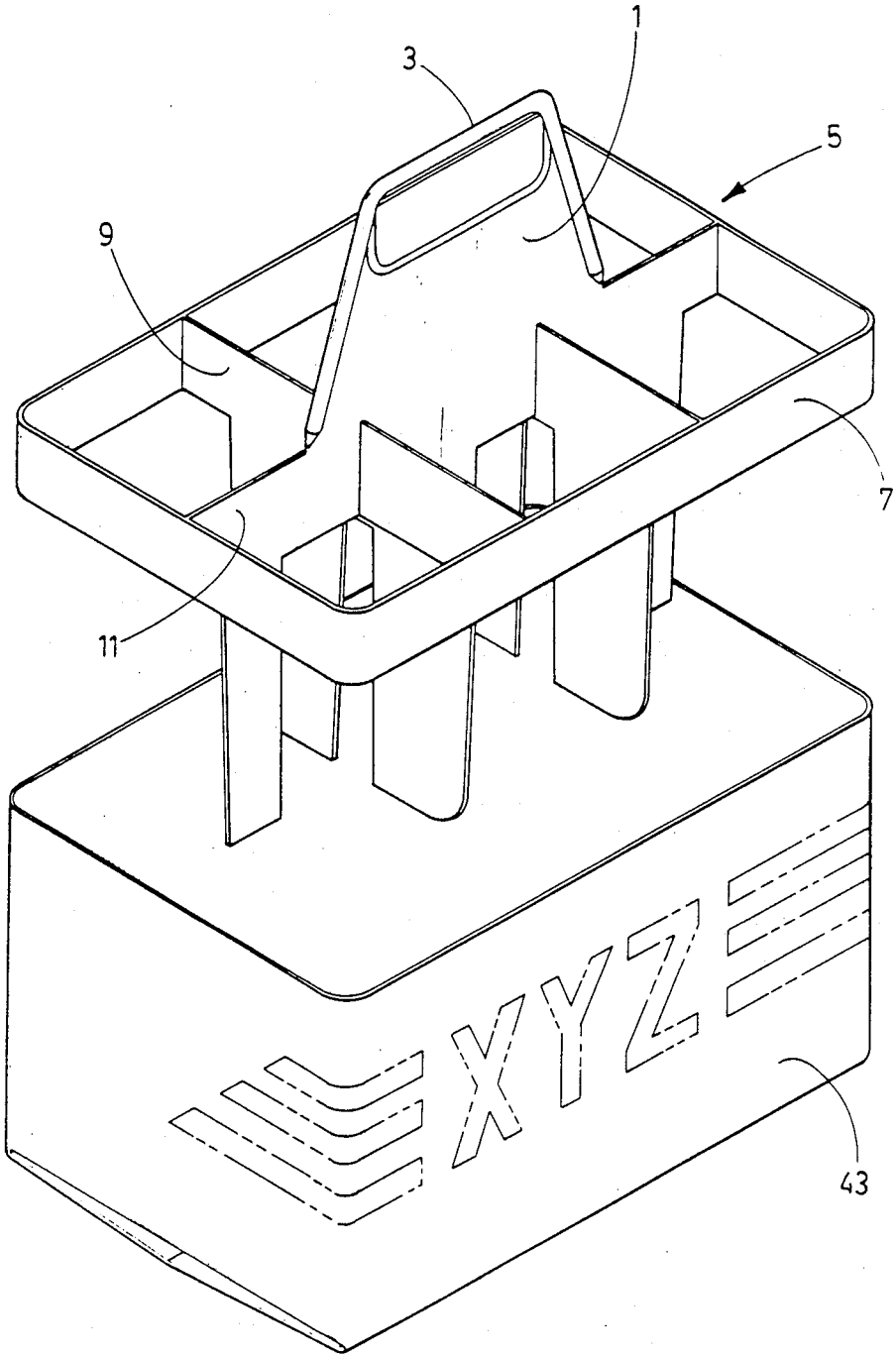

In FIG. 1 can be seen one embodiment of the carrier. A handle 1 defines a hand hold 3. Frame 5 consists of an outer rim 7 and frame members 9 and 11 which divide the frame into a plurality of cells. In FIG. 1, the members extend down from the frame to further divide the bag into compartments. For certain emodiments, particularly with plastic bottles, such extensions are not necessary and the frame itself acts as a sufficient divider. If the extensions of the frame into the bag are not needed, this enables the bag to collapse under the frame and it may not be necessary to make the frame members hinged so that the frame collapses as described below.

One frame member 11 extends substantially along the centre line of the carrier. In the preferred embodiment shown, the handle 1 is formed as an extension of this member. When the carrier is filled with either all full or all empty bottles, the handle will be substantially above a balance point of the carrier for ease of carrying.

Preferably, the frame will be collapsible about the central handle and into the plane of the handle as shown from above in a partially completed state in FIG. 3. This can be achieved by pivotably connecting or hinging the corners of the frame such as at points 13, 19, 23 and 29 and the points where the dividers intersect each other and touch the frame such as points 21, 31, 33, 35, 37 and 41.

In FIG. 2 is shown an enlarged portion of one such hinged point such as 21, shown on the dotted circle in FIG. 3.

Figure 5:
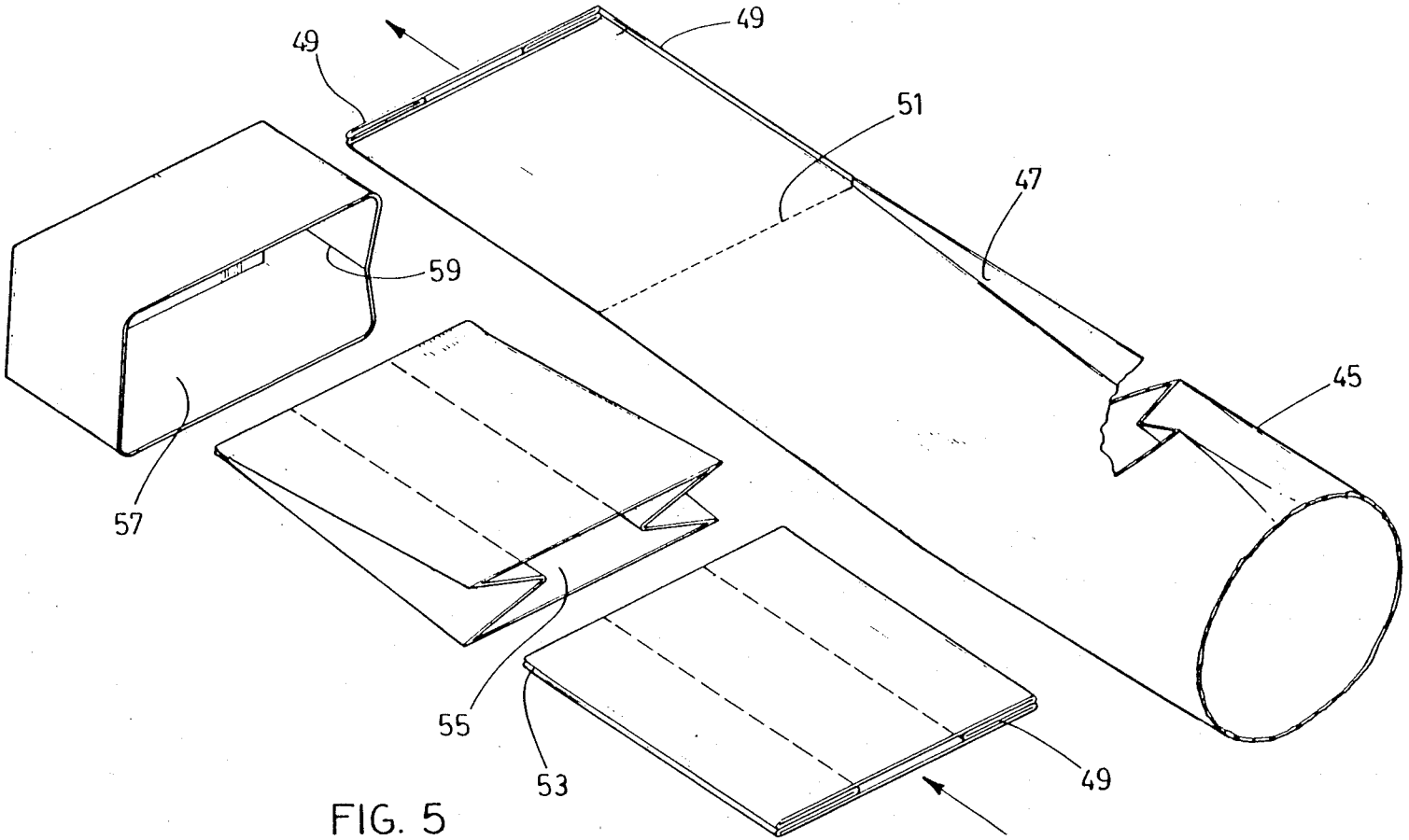
FIG. 5 illustrates sequential views of the method of manufacturing the bag.

The carrier is completed by the addition of a bag 43 made relatively thin plastic film. The thickness will depend on the size and type of bottles to be carried. It has been found that film of 5 mill is sufficient for most current sizes of bottles. It is expected that film of from 3 mill to 6 mill would be the preferred range in use, depending on the size and weight of the bottle to be carried. Preferably, the bag is formed as shown in FIG. 5. A tube of plastic film 45, such as polyethylene, is provided with a gusset, tuck or fold 47 on opposite sides of the tube. These gussets and the tube are flattened to create folds as shown at 49. The tube is cut at 51 corresponding to the size of bag desired. One end is heat sealed as at 53 and the other end opened as at 55. When fully opened or squared as at 57 and as shown in FIG. 4, the bag assumes a rectangular shape with the bottom folded as shown in the cut away portion of FIG. 4.

The bottom sealed joint 53 moves upwardly to form a centre line on the bottom as show in FIG. 4. At the same time, the gusset 49 is opened up with one part of the gusset folded onto itself to form a triangular fold 58 on the bottom as shown in FIG. 4. This results in a squared bottom. Part of the upper part of the gusset opens up to form the sides as shown at 59 in FIG. 5. The bottom can then be heat sealed in this shape so that the bottom cannot be thereafter unfolded or it can be left in this way since the presence of the bottles in the bag will normally prevent unfolding.

The bag is formed from a tube which, when fully opened, is matched to the frame so that the bag, when the corners are squared, forms a rectangle which just fits over the outside of the frame. The bag is heat sealed to the frame by conventional means. For a strong heat seal, it is desirable to use the same type of plastic in the bag and in the frame. Thus, for most Canadian contexts, the frame will be made of polyethylene and the bag will be a thin-walled film of polyethylene. For hotter climates, other plastics, such as polypropylene, may be preferred, always matching the plastic of the bag to the plastic of the frame, if possible. In fact, laminated films of part polyethylene and part polypropylene or other materials may be used. However, it is desirable tht the portion of the laminate that touches the frame be of the same material as the frame.

For drainage during cleaning, holes may be punched in the floor of the bag. The tube can and normally will be printed in known ways prior to assembly. Thus, the tube may be printed on the outside or if the bag is clear may be printed on the inside, and therefore, the printing protected from scratching. Alternatively, the film may be made with a printed layer sandwiched between a transparent layer on the inside according to known technology for printing polyethylene tubing.

Because the bag is folded with the seam at the bottom, there need be no seams along the possible printing surface, and therefore a message may be continuous around the entire perimeter of the carrier without discontinuties or the necessity of matching printing as shown particularly in FIG. 1.

It will be readily seen that when the carrier is full, the bottles provide structural support for the bag. The bottles are maintained in their position by the frame and its cellular dividing walls, and if required, they can be separated to prevent clanking or banging by divider extensions to the frame members into the bag. Since the bottles cannot substantially shift within the bag, the possibility of an unequal load distribution is reduced.

The rigid frame maintains the bag in a upright and open condition for filling by automatic machinery. A rigid handle upstanding from the frame as an extension of the central dividing member does not interfere with the "drop-packing" of the bottles and provides internal support for the frame.

While some preferred emodiments of the invention have been described, it is understood that there are many embodiments of the invention which are not specifically set out herein and which are intended to be covered by the scope of the claims which follow.

I claim:

1. A carrier for carrying a plurality of articles comprising:

a substantially stiff rectangular frame having a cellular structure to divide the interior of the frame into a plurality of article receiving compartments, a substantially rigid handle connected to the frame substantially along a center line of the frame, said handle being substantially perpendicular to the plane formed by the frame, and a bag closed at one end and open at the other, having its open end dimensioned to fit the dimensions of the frame, and secured thereto wherein the bag is a seamless plastic tube with the closed end of the bag being sealed and the bag folded and opened to a substantially rectangular shape.

2. A carrier as claimed in claim 1 wherein the frame is collapsible towards the plane of the handle.

3. A carrier as claimed in claim 2 wherein the cellular structure is formed from intersecting walls extending within and connected to the frame and the intersections of the walls, the points of attachment to the frame and the corners of the frame are hinged to allow the frame to collapse substantially towards the plane of the handle.

4. A carrier as claimed in claim 2 wherein the cellular structure is formed from intersecting walls extending within and connected to the frame and the intersections of the walls, the points of attachment to the frame and the corners of the frame are coined to allow the frame to collapse.

5. A carrier as claimed in claim 1 wherein the bag has the structure created when the tube is flattened by folding in the sides, one end is heat sealed and the tube is opened to form the bag.

6. A carrier as claimed in claim 1 wherein the bag is disengageably secured to the frame.

7. A carrier as claimed in claim 6, wherein the frame and its cellular structure are both made of the same type of plastic.

8. A carrier as claimed in claim 7 wherein printing is provided on the outer surface of the bag.

9. A carrier as claimed in claim 1 wherein the bag is made of relatively transparent plastic with printing located on the inner surface of the bag such that it can be viewed from the out surface of the bag.

10. A carrier as claimed in claim 2 wherein the cellular structure extends further into the bag for further dividing the interior of the bag into article receiving compartments.

11. A carrier as claimed in claim 1 wherein the rigid handle may move up and down in relation to the substantially stiff frame.

12. A carrier as claimed in claim 8 wherein the carrier further has a means for stiffening the closed end of the bag.

13. A carrier for carrying a plurality of articles comprising a rectangular, substantially stiff frame having a cellular structure formed from intersecting walls extending within and connected to the frame and the intersections of the walls, and the points of connection with the frame being pivotally connected to allow the frame to collapse substantial towards a plane substantially perpendicular to the plane formed by the frame, a rigid handle connected to the frame substantially along a centre line of the frame, said handle being substantially perpendicular to the plane formed by the frame, a bag being a seamless plastic tube open at one end closed at the other, folded into a rectangular box shape and having its open end dimensioned to fit over the outer dimensions of the frame, and secured thereto.

14. A carrier as claimed in claim 13 wherein the points of intersection of the walls and the points of connection between the frame and the walls are coined to provide hinges.

15. A carrier as claimed is claim 14 wherein the bag is heat sealed to the frame and the bag and frame are both made of the same plastic.

16. A carrier as claimed in claim 15, wherein the bag is made of relatively transparent plastic with printing located on the inner surface of the bag such that it can be viewed from the outer surface of the bag.

17. A carrier as claimed in claim 16 wherein the cellular structure further extends into the bag for dividing the interior of the bag into article receiving compartments.

18. A carrier as claimed in claim 17 wherein the bag has the structure created when the tube is flattened by folding in the sides, one end is heat sealed and the tube is opened to form the bag.

19. A carrier for carrying a plurality of articles comprising:

first walls which form a frame in a first position;

second walls which extend within and are connected to the frame such that wall intersections form pivotal connections to permit movement of the walls relative to each other so that the frame may be substantially collapsed onto itself in a second position;

a handle connected to the frame along a center line of the frame in the first position; and a bag comprising a flexible plastic tube, closed at a first end of the tube, dimensioned at a second end of the tube to match the frame and secured thereto, so as to form a box when the frame is in the first position.

20. A carrier as claimed in claim 1 wherein the bag and frame are of heat sealable material and the bag is heat sealed to the frame.

* * * * *